US011981528B2

(12) United States Patent
Watanabe et al.

(10) Patent No.: US 11,981,528 B2
(45) Date of Patent: May 14, 2024

(54) COATING TRANSFER TOOL

(71) Applicant: FUJICOPIAN CO., LTD., Osaka (JP)

(72) Inventors: Kazuya Watanabe, Osaka (JP); Tomio Kaneda, Osaka (JP)

(73) Assignee: FUJICOPIAN CO., LTD., Osaka (JP)

( * ) Notice: Subject to any disclaimer, the term of this patent is extended or adjusted under 35 U.S.C. 154(b) by 244 days.

(21) Appl. No.: 17/632,945

(22) PCT Filed: Jul. 9, 2020

(86) PCT No.: PCT/JP2020/026781
§ 371 (c)(1),
(2) Date: Feb. 4, 2022

(87) PCT Pub. No.: WO2021/053938
PCT Pub. Date: Mar. 25, 2021

(65) Prior Publication Data

US 2022/0332534 A1 Oct. 20, 2022

(30) Foreign Application Priority Data

Sep. 19, 2019 (JP) ..... 2019-170080

(51) Int. Cl.
*B65H 37/00* (2006.01)

(52) U.S. Cl.
CPC ..... *B65H 37/007* (2013.01); *B65H 2701/194* (2013.01); *B65H 2701/37* (2013.01)

(58) Field of Classification Search
CPC ..... B65H 37/007; B65H 2402/41; B65H 2407/50
See application file for complete search history.

(56) References Cited

U.S. PATENT DOCUMENTS

2006/0244558 A1* 11/2006 Kinugasa ..... B65H 37/007 335/202
2009/0028620 A1 1/2009 Kinugasa
2015/0368004 A1 12/2015 Kobashi et al.

FOREIGN PATENT DOCUMENTS

JP 1992125384 U 11/1992
JP 2006305839 A 11/2006
(Continued)

OTHER PUBLICATIONS

International Search Report issued in Intl. Appln. No. PCT/JP2020/026781 mailed Sep. 29, 2020. English translation provided.
(Continued)

*Primary Examiner* — Daniel McNally
(74) *Attorney, Agent, or Firm* — ROSSI, KIMMS & McDOWELL LLP

(57) ABSTRACT

The coating film transfer tool includes a feeding portion that feeds tape with a coating film, a transfer head that transfers the coating film from the tape onto a transfer target surface, a cassette to which the transfer head is fixed, and a head cap. Shaft portions are provided on either the head cap or the transfer head/cassette, and shaft bearing holes are provided on the other one. Due to relative rotation of the shaft portions, the head cap rotates between a closed position for covering the transfer head and an open position for exposing the transfer head. The distances from the rotation axis to the shaft portion and to the shaft bearing hole change along the circumferential direction. The head cap is biased toward the closed position when located on the closed position side, and is biased toward the open position when located on the open position side.

4 Claims, 13 Drawing Sheets

(56) References Cited

FOREIGN PATENT DOCUMENTS

| | | | |
|---|---|---|---|
| JP | 200929053 | A | 2/2009 |
| WO | 2011122774 | A2 | 10/2011 |

OTHER PUBLICATIONS

Written Opinion issued in Intl. Appln. No. PCT/JP2020/026781 mailed Sep. 29, 2020.
Extended European Search Report issued in European Appln. No. 20866851.7 mailed Nov. 15, 2023.

* cited by examiner

COATING TRANSFER TOOL

TECHNICAL FIELD

The present invention relates to a coating film transfer tool for transferring a coating film for character correction, adhesion, decoration, or the like to a transfer target surface such as a paper surface.

BACKGROUND ART

A coating film transfer tool is generally configured such that a coating film, which has been applied to the outer surface of tape wound around a transfer head that protrudes from a cassette, is pressed against and transferred to a transfer target surface. Accordingly, the coating film is exposed to the outside, and the coating film may become damaged when not in use, such as the coating film unintentionally touching something and peeling off from the tape, or waste matter adhering to the coating film. In such a case, various problems may occur during subsequent use, such as unevenness in the coating film after transferal to the transfer target surface, or waste matter being transferred to the transfer target surface together with the coating film.

In view of this, Patent Literature 1 discloses a coating film transfer tool that is provided with a head cap for protecting the coating film on the outer surface of the tape wound around the transfer head when not in use. The head cap rotates between a closed position for covering the transfer head when not in use and an open position for exposing the transfer head when in use. Also, a dead center point is formed between the closed position and the open position, and the head cap is biased so as to move toward the closed position when located on the closed position side of the dead center point, and to move toward the open position when located on the open position side of the dead center point. Accordingly, the user can easily perform the operation of switching the position of the head cap to the open position or the closed position when using and no longer using the coating film transfer tool. Such a head cap biasing mechanism is configured by fine protrusions that protrude from pivot shaft portions provided on the head cap, and a cam surface on which the protrusions slide. The cam surface is arranged so as to surround columnar shaft bearing holes that receive the likewise columnar pivot shaft portions.

CITATION LIST

Patent Literature

Patent Literature 1: JP 2009-29053A

SUMMARY OF INVENTION

Technical Problem

The biasing force that realizes the biasing mechanism of Patent Literature 1 is elastic force generated by elastic deformation of the head cap, which is caused by the fine protrusions moving while being pressed against the cam surface. In other words, force for deformation of the head cap when switching to the closed position or the open position acts on the protrusions, and thus there is a possibility that the fine protrusions may become damaged over repeated use.

An object of the present invention is to provide a coating film transfer tool provided with a highly durable head cap biasing mechanism.

Solution to Problem

A coating film transfer tool according to a first aspect includes: a feeding portion configured to feed a transfer tape that includes a base tape and a coating film provided on the base tape; a transfer head configured to transfer the coating film fed from the feeding portion to a transfer target surface by pressing the transfer tape onto the transfer target surface; a winding portion configured to wind the base tape after transfer of the coating film; a cassette that houses the feeding portion and the winding portion, and to which the transfer head is fixed; and a head cap configured to rotate between a closed position for covering the transfer head and an open position for exposing the transfer head. Out of two elements including the head cap and the transfer head or the cassette, a shaft portion having a rotation axis is provided on one of the two elements, a shaft bearing portion having a shaft bearing hole that receives the shaft portion is provided on another one of the two elements, and the head cap rotates between the closed position and the open position by relative rotation of the shaft portion around the rotation axis in the shaft bearing hole. In a view along the rotation axis, the distance from the rotation axis to the shaft portion changes along a circumferential direction. In a view along the rotation axis, the distance from the rotation axis to the shaft bearing hole changes along the circumferential direction. When the head cap is on a closed position side of a dead center point that is between the closed position and the open position, the head cap is biased toward the closed position by elastic force that acts on at least one of the two elements, and when the head cap is on an open position side of the dead center point, the head cap is biased toward the open position by elastic force that acts on at least one of the two elements.

A coating film transfer tool according to a second aspect is the coating film transfer tool according to the first aspect, wherein the shaft bearing hole and the shaft portion each have an elliptical shape in a view along the rotation axis.

A coating film transfer tool according to a third aspect is the coating film transfer tool according to the first aspect or the second aspect, wherein the shaft portion has a conical shape or a frustrum shape.

A coating film transfer tool according to a fourth aspect is the coating film transfer tool according to any one of the first to third aspects, wherein in a view along the rotation axis, the shaft portion has, on an outer periphery, a first point and a second point that intersect a line segment corresponding to a maximum diameter of the shaft portion. In a view along the rotation axis, the shaft bearing hole has, on an outer periphery: a first position, a second position, a third position that is located between the first position and the second position, and is at a shorter distance from the rotation axis than the first position and the second position are, a first transition region that is continuous with the third position and extends from the third position toward the first position, the distance from the rotation axis gradually increasing while extending from the third position to the first position, and a second transition region that is continuous with the third position and extends from the third position toward the second position, the distance from the rotation axis gradually increasing while extending from the third position to the second position. The head cap is at the closed position when the first point is aligned with the first position, the head cap is at the open position when the first point is aligned with the second position, the head cap is at the dead center point when the first point is aligned with the third position, when the first point is in the first transition region, the head cap is on a closed position side of the dead center point and is biased toward the closed position, and when the first point is in the second transition region, the head cap is on an open position side of the dead center point and is biased toward the open position.

Advantageous Effects of Invention

According to the present invention, it is possible to provide a coating film transfer tool that includes a head cap that rotates between a closed position for covering a transfer head and an open position for exposing the transfer head. The head cap is configured so as to be biased toward the closed position when located on the closed position side of a dead center point that is between the closed position and the open position, and so as to be biased toward the open position when located on the open position side of the dead center point. The biasing mechanism of the head cap is constituted by a shaft portion provided on one of two elements including the head cap and the transfer head or the cassette, and a shaft bearing hole provided on the other one of the two elements, and the head cap rotates due to relative rotation of the shaft portion in the shaft bearing hole. Also, in a view along the rotation axis, the distances from the rotation axis to the shaft portion and to the shaft bearing hole change along the circumferential direction. For this reason, when the relative rotation position of the shaft portion in the shaft bearing hole changes along with rotation of the head cap, the magnitude of the elastic force acting on the two elements also changes. Here, the biasing mechanism of the head cap that has a simple structure is realized by using such elastic force as biasing force. Accordingly, a highly durable head cap biasing mechanism is provided.

DESCRIPTION OF EMBODIMENTS

Hereinafter, a coating film transfer tool according to an embodiment of the present invention will be described with reference to the drawings.

1. Overall Configuration of Coating Film Transfer Tool

Figure 1:
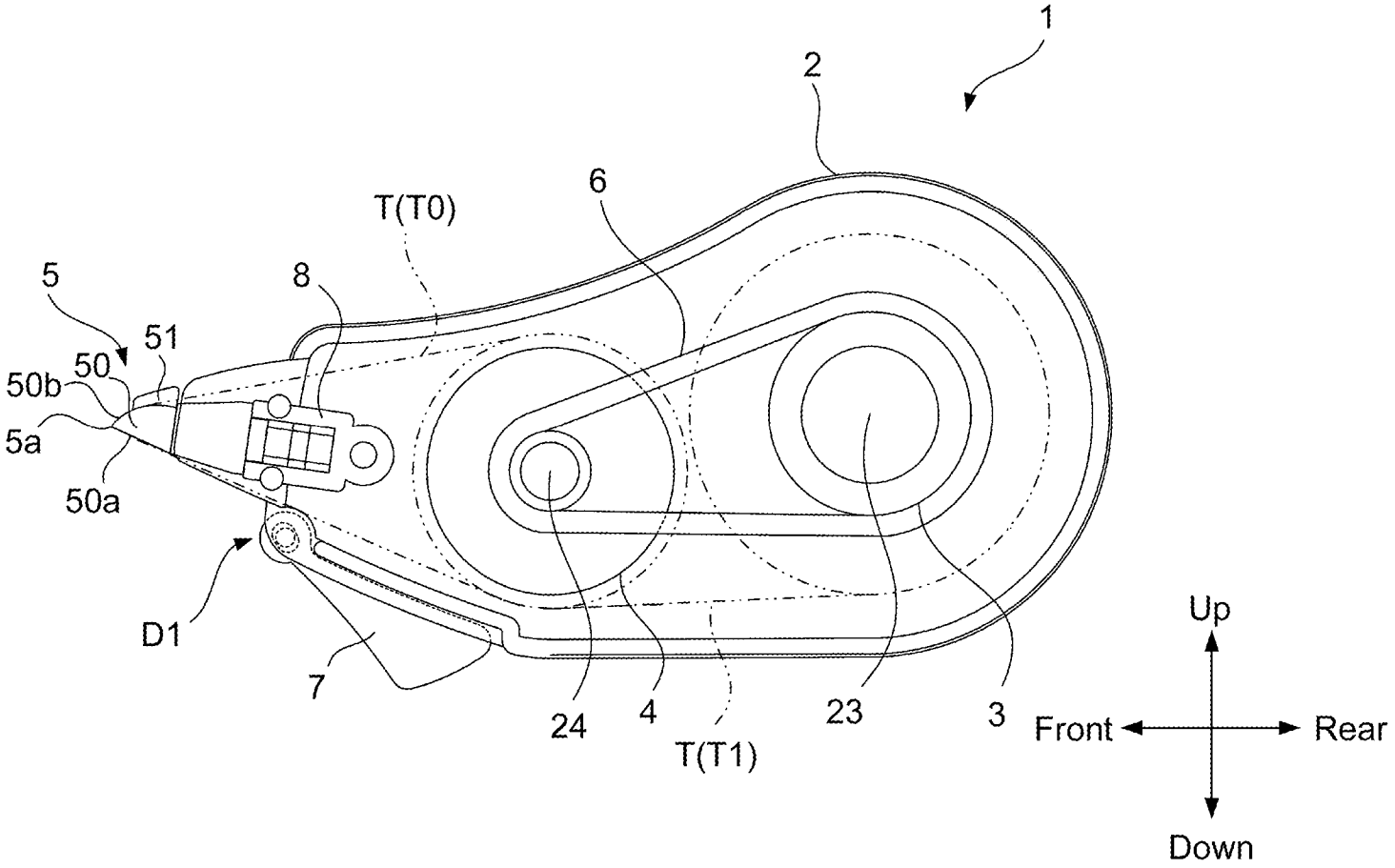
FIG. 1 is a left side view of a coating film transfer tool according to an embodiment of the present invention.
Figure 2:
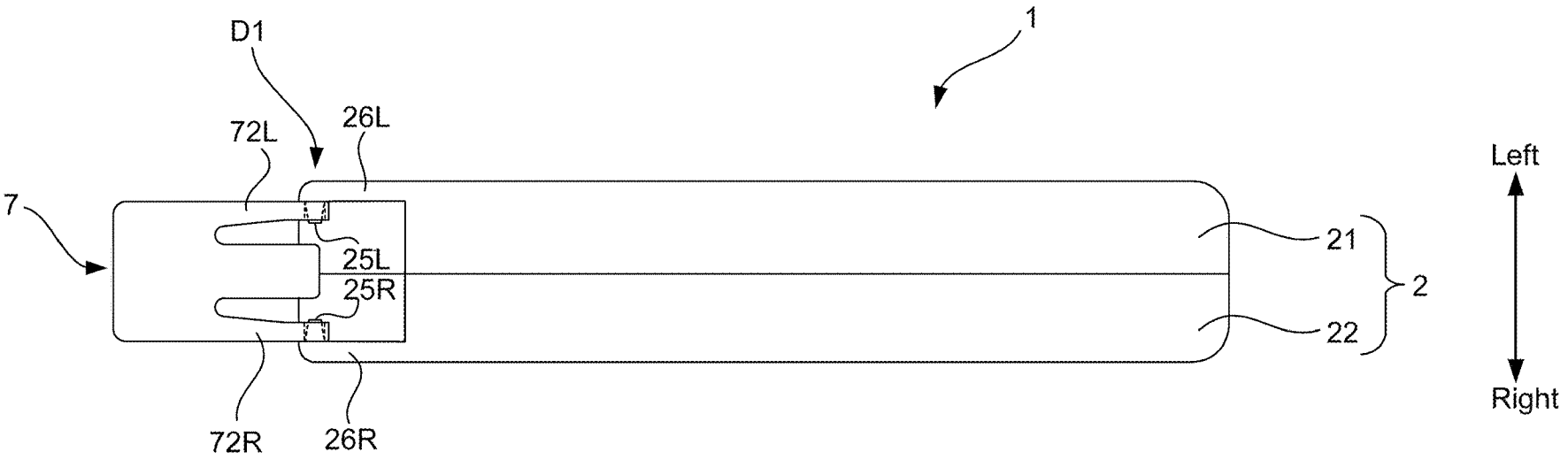
FIG. 2 is a bottom view of the coating film transfer tool.

FIGS. 1 and 2 are a left side view and a bottom view of a coating film transfer tool 1 according to the present embodiment. The coating film transfer tool 1 is a tool for transferring a coating film for character correction, adhesion, decoration, or the like to a transfer target surface such as a paper surface. As shown in FIGS. 1 and 2, the coating film transfer tool 1 includes a feeding reel 3, a winding reel 4, a transfer head 5, and a cassette 2. The feeding reel 3 and the winding reel 4 are housed in the cassette 2, and the transfer head 5 is fixed to a front end portion of the cassette 2. Note that the inside of the cassette 2 cannot actually be seen in the side view of FIG. 1, but the inside of the cassette 2 is shown here for the sake of the description. The same applies to FIG. 4A, FIG. 5A, and FIG. 6A. Also, in the following description, unless otherwise specified, the terms front/rear and upper/lower are defined as shown in FIG. 1, and the terms left/right are defined as shown in FIG. 2 based on the direction from rear to front.

Transfer tape T1 is wound around the feeding reel 3. The transfer tape T1 includes base tape T0 and a coating film provided on the base tape T0. The base tape T0 is typically a thin film made of synthetic resin or paper, and the coating film is applied to only one surface of the base tape T0. As shown in FIG. 1, the transfer tape T1 is fed from the feeding reel 3, advances the vicinity of the lower end portion of the cassette 2, passes through an opening formed in the front end portion of the cassette 2, and moves to the outside of the cassette 2. The transfer tape T1 then advances further along a lower surface 50*a* of the transfer head 5 located in front of the cassette 2, makes a U-turn at a front edge 5*a* of the transfer head 5, and further advances along an upper surface 50*b* of the transfer head 5. Here, the transfer tape T1 is pressed against the transfer target surface at the front edge 5*a* of the transfer head 5, and thus the coating film on the transfer tape T1 is transferred to the transfer target surface. Accordingly, the base tape T0 and the coating film become separated at the front edge 5*a* of the transfer head 5, and in principle, only the base tape T0, from which the coating film has been peeled off, moves to a position above the transfer head 5. Note that in this configuration, when the entirety of the coating film transfer tool 1 is moved so as to slide over the transfer target surface while pressing the front edge 5*a* of the transfer head 5, on which the transfer tape T1 is wound, against the transfer target surface, the coating film is transferred to the transfer target surface. For this reason, the surface of the base tape T0 to which the coating film is applied is the outer surface relative to the transfer head 5. After transfer of the coating film, the base tape T0 is folded back at the front edge 5*a* of the transfer head 5 and then travels rearward along the upper surface 50*b* of the transfer head 5, passes through another opening formed in the front end portion of the cassette 2 and returns to the inside of the cassette 2, and is then wound on the winding reel 4. Hereinafter, the transfer tape T1 and the base tape T0 will sometimes simply be referred to as the tape T when there is no need to distinguish between them.

As shown in FIG. 2, the cassette 2 includes a pair of cases 21 and 22 that can be separated laterally. A support shaft 23 extends from either one of the cases 21 and 22 toward the other one, and the feeding reel 3 is rotatably attached to the support shaft 23. Similarly, a support shaft 24 extends from either one of the cases 21 and 22 toward the other one, and the winding reel 4 is rotatably attached to the support shaft 24. Note that the support shafts 23 and 24 may be provided on the same case out of the cases 21 and 22, or may be provided on different sides. Although the present invention is not limited to this, in the present embodiment, the support shaft 23 for the feeding reel 3 is arranged rearward of the support shaft 24 for the winding reel 4 in the cassette 2.

The coating film transfer tool 1 further includes a conjunct rotation mechanism 6 for conjunct rotation of the feeding reel 3 and the winding reel 4. Although the present invention is not limited to this, in the present embodiment, the conjunct rotation mechanism 6 is realized by an O-ring that is wound around the feeding reel 3 and the winding reel 4. However, a structure in which the feeding reel 3 and the winding reel 4 are interlocked by a gear or the like can be adopted as the structure of the conjunct rotation mechanism 6, for example, and there are no particular limitations in this respect.

Figure 3:
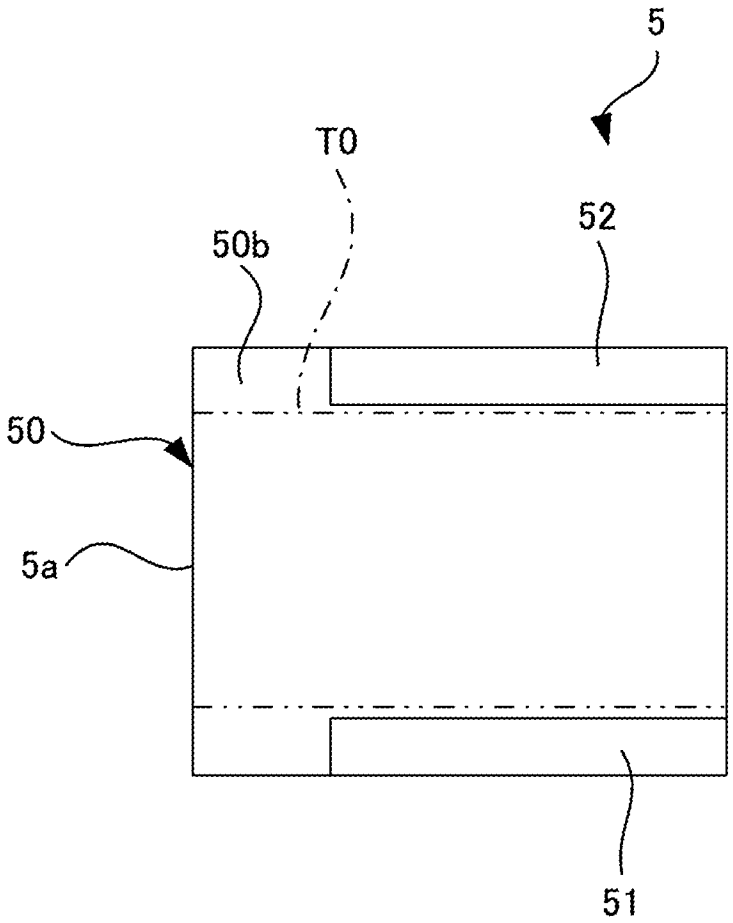
FIG. 3 is a plan view of the transfer head.

FIG. 3 is a plan view of the transfer head 5. As shown in FIGS. 1 and 3, the transfer head 5 includes a head body 50 that guides the tape T, and left and right side wall portions 51 and 52 that limit the course of the tape T such that the tape T does not fall off from the left or right sides of the head body 50. The lower surface 50*a* of the head body 50 guides the transfer tape T1 while in surface contact therewith or in close proximity. The lower surface 50*a* is a flat surface and is continuous with the upper surface 50*b* at the front edge 5*a* of the head body 50. The front edge 5*a* extends in a straight line in the left-right direction. The upper surface 50*b* is a curved surface that is slightly curved in a side view and guides the base tape T0, which has separated from the coating film at the front edge 5*a*, while in surface contact therewith or in close proximity. FIG. 3 shows the position of the base tape T0 for reference. The side wall portions 51 and 52 extend upward from left and right end portions of the upper surface 50*b* of the head body 50.

A coupling portion 8 is arranged rearward of the transfer head 5. The rear portion of the coupling portion 8 is inserted into the cassette 2, and the transfer head 5 is fixed to the cassette 2 via the coupling portion 8. In the present embodiment, the transfer head 5 and the coupling portion 8 are integrated with each other.

The coating film transfer tool 1 further includes a head cap 7 for protecting the portion of the coating film of the transfer tape T1 that is located below the transfer head 5. The head cap 7 rotates around a rotation axis C1 between a closed position for covering the lower surface 50*a* of the transfer head 5 (see FIGS. 4A and 4B) and an open position for exposing the lower surface 50*a* of the transfer head 5 (see FIGS. 6A and 6B). The rotation axis C1 extends parallel (including substantially parallel) to the left-right direction.

Figures 6A, 6B:
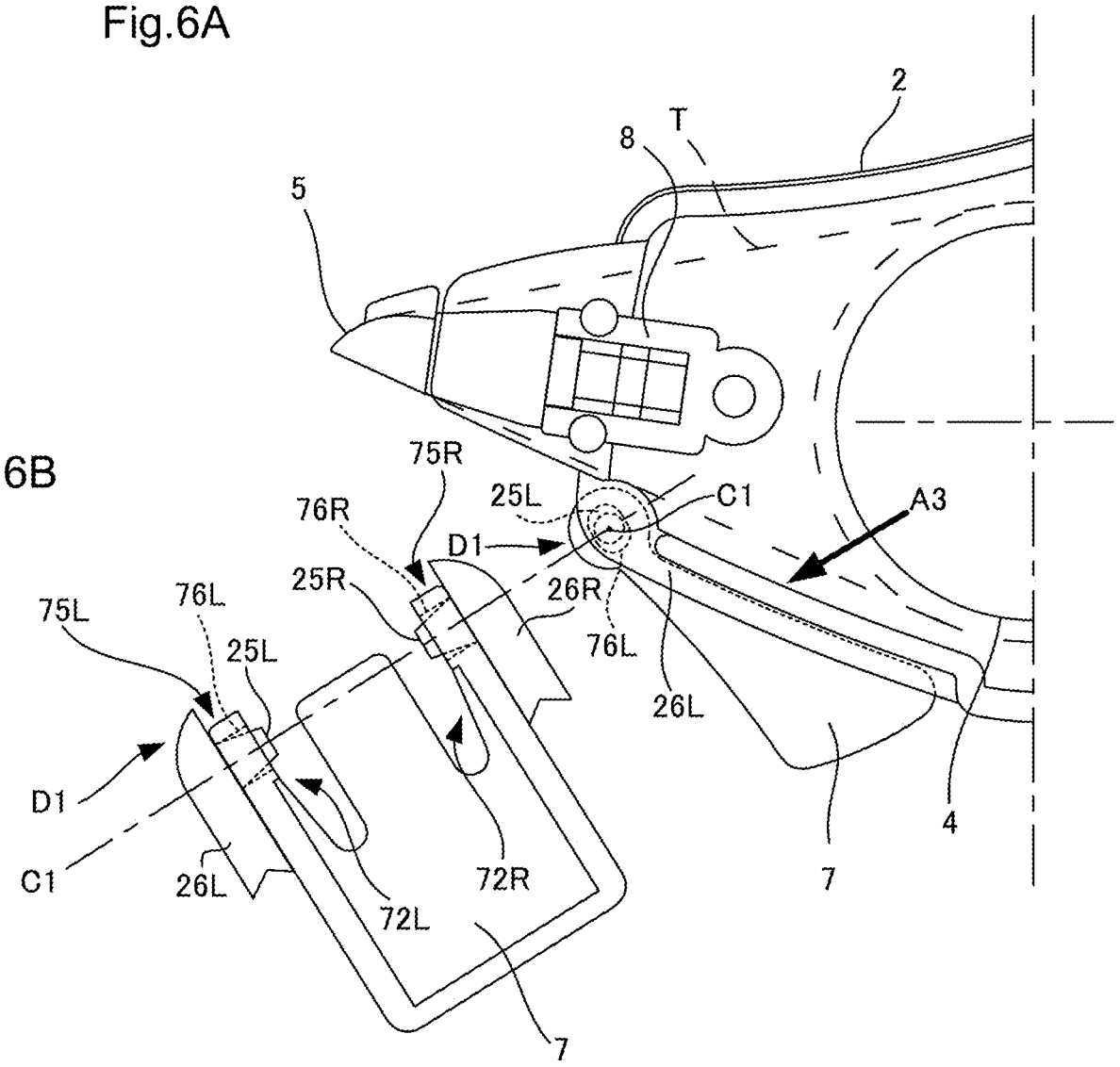
FIG. 6A is a left side view of the head cap at the open position and the periphery thereof.
FIG. 6B is a diagram showing the positional relationship between the head cap at the open position and the shaft portions.

When the coating film is to be transferred, in order to prevent the presence of the head cap 7 from interfering with the transfer operation, the head cap 7 is set to the open position shown in FIGS. 6A and 6B so that the head cap 7 is out of the way below the transfer head 5. On the other hand, when the coating film is not to be transferred, the head cap 7 is set at the closed position shown in FIGS. 4A and 4B such that the portion of the coating film constituting the outer surface of the transfer tape T1 that is located below the transfer head 5 does not become damaged. Accordingly, the head cap 7 covers and protects the portion of the coating film below the transfer head 5. Note that the damage to the coating film referred to here means, for example, that the coating film unintentionally touches something and peels off from the transfer tape T1, or that waste matter adheres to the coating film.

Also, the coating film transfer tool 1 is provided with a biasing mechanism D1 for assisting the user operation of opening and closing the head cap 7. The biasing mechanism D1 forms a dead center point between the closed position and the open position (see FIGS. 5A and 5B). Accordingly, when the head cap 7 is tilted to the closed position side of the dead center point, it is biased toward the closed position, and when it is tilted to the open position side of the dead center point, it is biased toward the open position.

Figure 7A:
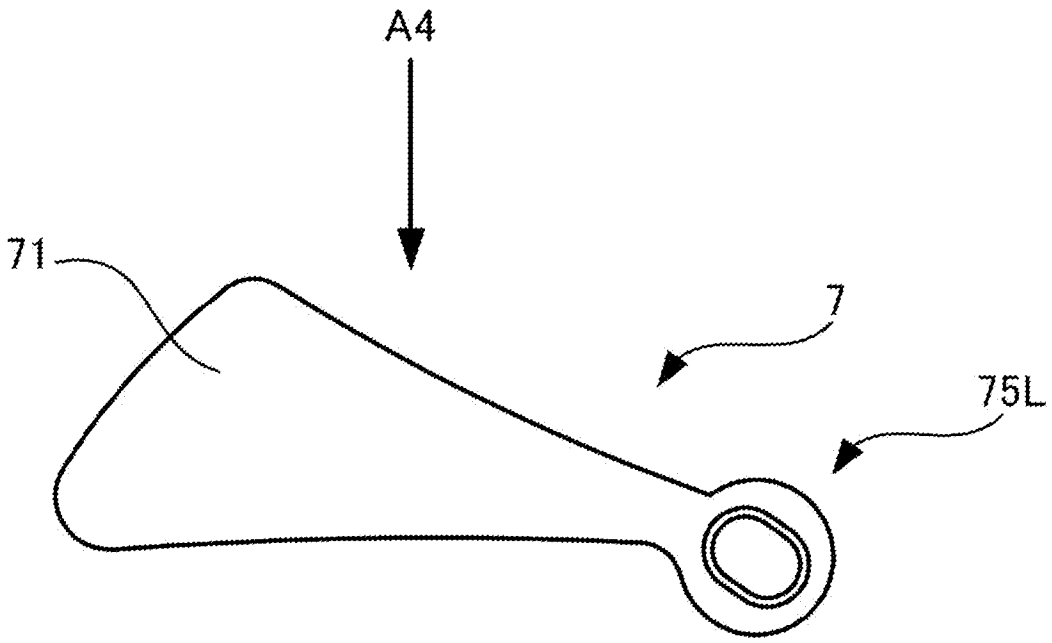
FIG. 7A is the left side view of the head cap.
Figure 7B:
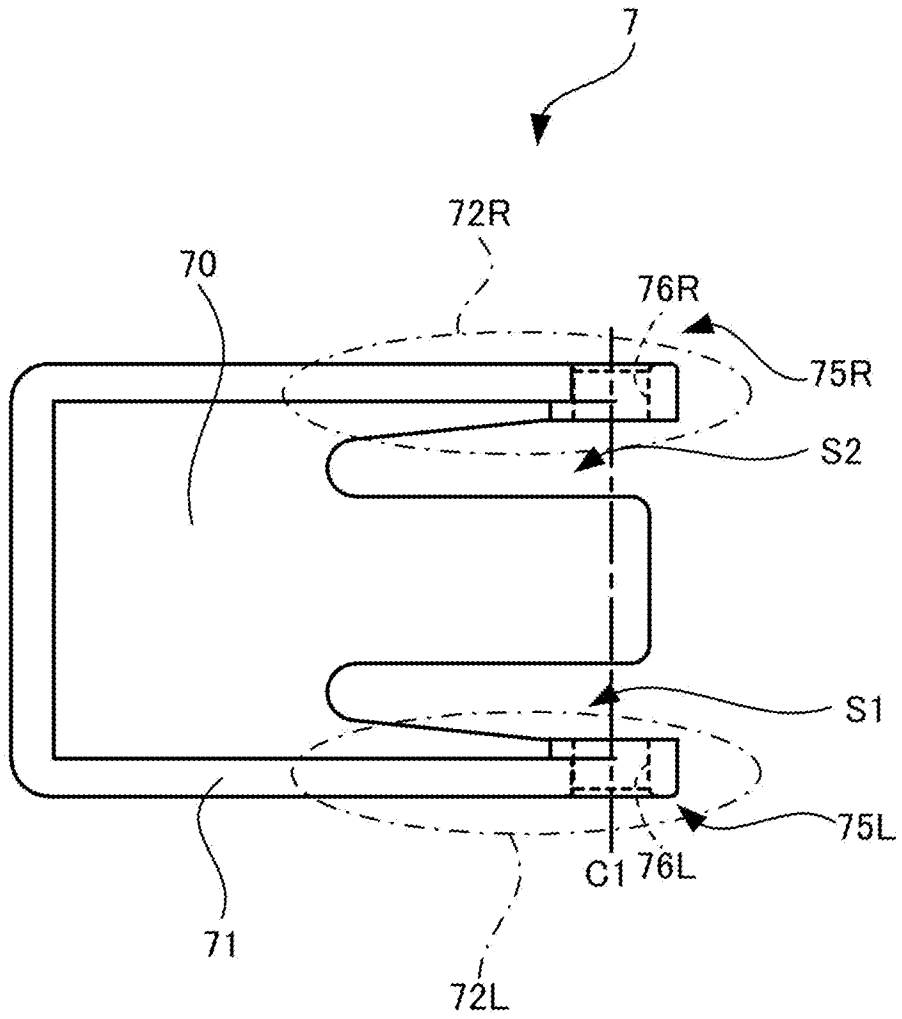
FIG. 7B is a diagram showing the head cap when viewed from the direction of an arrow A4 shown in FIG. 7A.

FIG. 7A is a left side view of the head cap 7, and FIG. 7B shows the head cap 7 when viewed from the direction of an arrow A4 shown in FIG. 7A. As shown in these figures, the head cap 7 has a plate-shaped main body portion 70 and a side wall portion 71 that rises along the periphery of the main body 70 on one surface side thereof. The side wall portion 71 extends along the left and right end portions and the front end portion of the main body portion 70. Note that as described above, the head cap 7 rotates around the rotation axis C1 that is parallel with the left-right direction, and therefore the positional relationship with respect to the front-rear direction and the up-down direction changes depending on the rotation position.

Accordingly, unless otherwise specified, the terms front/back and upper/lower used when describing the head cap 7 are defined based on the state in which the head cap 7 is arranged at the rotation position shown in FIG. 7A.

A pair of shaft bearing portions 75L and 75R are respectively continuous with left and right end portions of the rear end portion of the main body portion 70 of the head cap 7. Shaft bearing holes 76L and 76R are respectively formed in the shaft bearing portions 75L and 75R, and the shaft bearing holes 76L and 76R respectively receive shaft portions 25L and 25R that will be described later. Also, notches S1 and S2 are formed at positions slightly spaced inward from the left and right end portions of the rear end portion of the main body portion 70 of the head cap 7. The shaft bearing portions 75L and 75R are respectively arranged outward of the notches 51 and S2 in the left-right direction. As a result, a pair of elongated elastic pieces 72L and 72R that extend in the front-rear direction are respectively formed in the left and right end portions of the head cap 7. The elastic piece 72L includes the shaft bearing portion 75L and a portion of the side wall portion 71, and the elastic piece 72R includes the shaft bearing portion 75R and a portion of the side wall portion 71.

Note that the head cap 7 is made of an elastically deformable material, and is preferably made of a synthetic resin such as polypropylene, polystyrene, or polyacetal, but the present invention is not limited to this. Since the elastic pieces 72L and 72R are thin in the left-right direction, they can undergo elastic deformation such that the shaft bearing portions 75L and 75R located at the rear end portions move in the left-right direction. Also, in the present embodiment, the feeding reel 3, the winding reel 4, the cassette 2, and the transfer head 5 are also made of an elastically deformable material, and are preferably made of a synthetic resin such as polypropylene, polystyrene, or polyacetal, but the present invention is not limited to this.

2. Configuration of Biasing Mechanism

Hereinafter, the configuration of the biasing mechanism D1 will be described in detail. As described above, the biasing mechanism D1 is a mechanism that assists the user operation of switching the open/closed state of the transfer head 5 by rotating the head cap 7. More specifically, when the head cap 7 is on the closed position side of the dead center point, the biasing mechanism D1 exerts biasing force in the direction of rotating the head cap 7 from the dead center point toward the closed position. On the other hand, when the head cap 7 is located on the open position side of the dead center point, biasing force is exerted in the direction of rotating the head cap 7 from the dead center point toward the open position. Accordingly, in the case where the head cap 7 is rotated from the closed position to the open position, if the head cap 7 is manually pushed from the closed position to a position slightly past the dead center point, the head cap 7 automatically rotates to the open position due to the biasing force. This similarly applies to the case where the head cap 7 is rotated from the open position to the closed position.

Figure 4A:
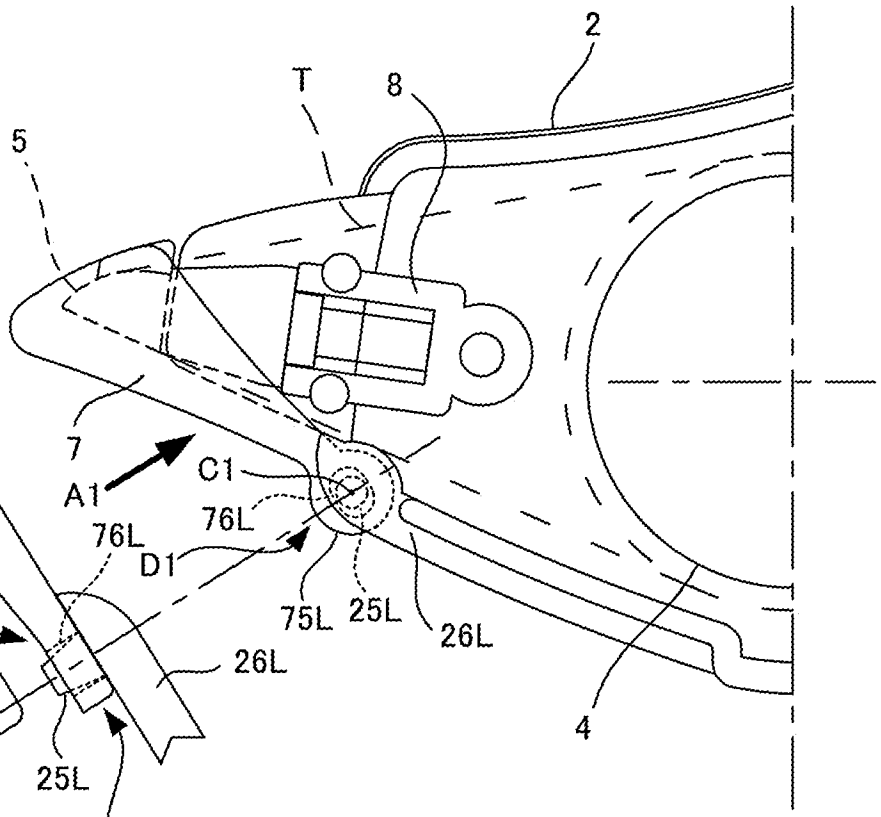
FIG. 4A is a left side view of the head cap at a closed position and the periphery thereof.
Figure 4B:
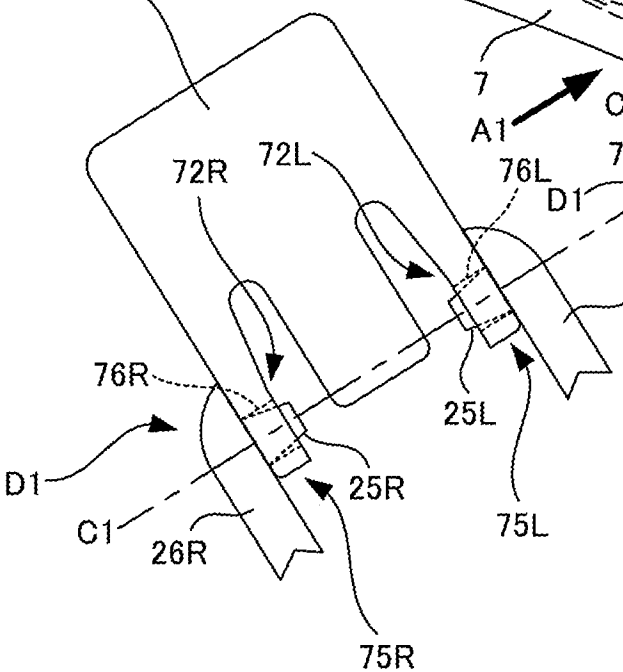
FIG. 4B is a diagram showing the positional relationship between the head cap at the closed position and shaft portions.
Figure 5A:
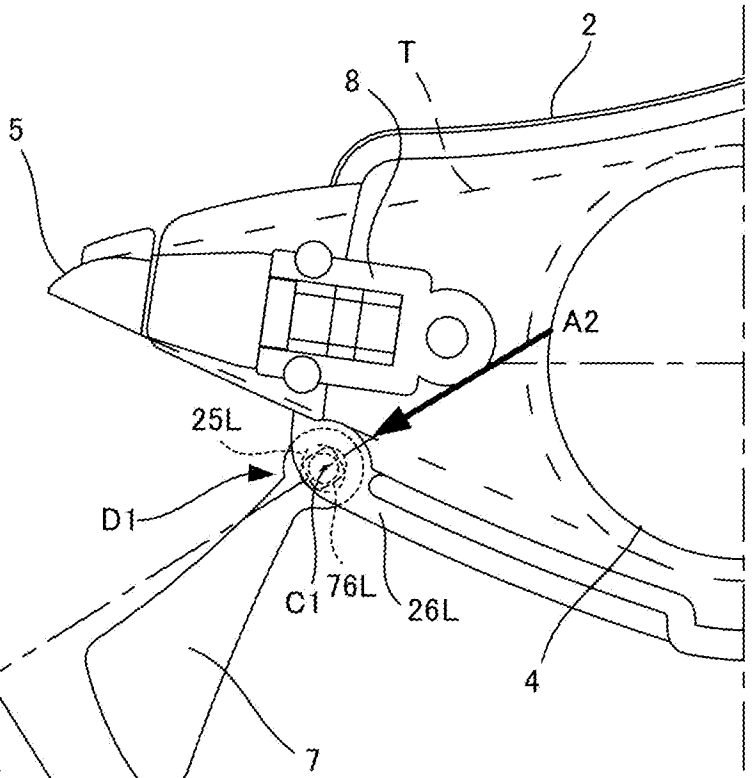
FIG. 5A is a left side view of the head cap at a dead center point and the periphery thereof.
Figure 5B:
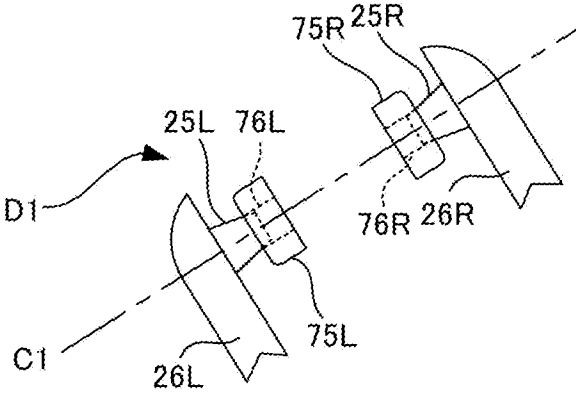
FIG. 5B is a diagram showing the positional relationship between shaft bearing portions and the shaft portions at the dead center point.

The biasing mechanism D1 includes the shaft bearing portions 75L and 75R provided on the head cap 7, and the shaft portions 25L and 25R respectively received by the shaft bearing portions 75L and 75R. FIG. 4A is a left side view of the head cap 7 at the closed position and the periphery thereof, and FIG. 4B is a diagram showing the positional relationship between the head cap 7 and the shaft portions 25L and 25R at that time, in a view from the direction of an arrow A1 in FIG. 4A. FIG. 5A is a left side view of the head cap 7 at the dead center point and the periphery thereof, and FIG. 5B is a diagram showing the positional relationship between the shaft bearing portions 75L and 75R and the shaft portions 25L and 25R at that time, in a view from the direction of an arrow A2 in FIG. 5A. FIG. 6A is a left side view of the head cap 7 at the open position and the periphery thereof, and FIG. 6B is a diagram showing the positional relationship between the head cap 7 and the shaft portions 25L and 25R at that time, in a view from the direction of an arrow A3 in FIG. 6A.

As shown in FIGS. 4A to 6B, the shaft portions 25L and 25R are provided in the cassette 2. More specifically, a pair of elongated elastic pieces 26L and 26R that extend in the front-rear direction are respectively formed on left and right end portions below the front end portion of the cassette 2. The left shaft portion 25L protrudes rightward from the right side surface of the left elastic piece 26L. On the other hand, the right shaft portion 25R protrudes leftward from the left side surface of the right elastic piece 26R. The left shaft portion 25L is inserted from the left side into the shaft bearing hole 76L of the left shaft bearing portion 75L, and the right shaft portion 25R is inserted from the right side into the shaft bearing hole 76R of the right shaft bearing portion 75R. Note that although a portion of the head cap 7, portions of the shaft portions 25L and 25R, a portion of the shaft bearing portion 75L, and the shaft bearing holes 76L and 76R cannot be actually be seen in FIGS. 4A to 6B the positions thereof are indicated by dotted lines for reference. The same applies to FIGS. 1, 2, and 7B.

In the present embodiment, the shaft portions 25L and 25R each have an elliptical shape when viewed along the rotation axis C1. More specifically, the shaft portions 25L and 25R each have an elliptical frustum shape, with an elliptical bottom surface and a substantially circular top surface. When viewed along the rotation axis C1, the centroids of the shaft portions 25L and 25R (i.e., the centroids of the bottom surfaces) are overlapped with the rotation axis C1. Accordingly, in a view along the rotation axis C1, the distances from the rotation axis C1 to the shaft portions 25L and 25R change along the circumferential direction. Also, the bottom surface sides of the shaft portions 25L and 25R respectively face the elastic pieces 26L and 26R, and the top surface sides face more inward. In the present embodiment, a straight line passing through the center (centroid) of the bottom surface and the center (centroid) of the top surface of the shaft portion 25L is parallel (including substantially parallel) with the rotation axis C1, but the present invention is not limited to this, and the top surface may be eccentric with respect to the bottom surface. The same applies to the shaft portion 25R.

Also, in the present embodiment, the shaft bearing holes 76L and 76R also have an elliptical shape respectively when viewed along the rotation axis C1. More specifically, the shaft bearing holes 76L and 76R each have an elliptical column shape. When viewed along the rotation axis C1, the centroids of the shaft bearing holes 76L and 76R are overlapped with the rotation axis C1. Accordingly, when viewed along the rotation axis C1, the distances from the rotation axis C1 to the shaft bearing holes 76L and 76R also change along the circumferential direction. Also, the shapes of the shaft bearing holes 76L and 76R are similar to the shaft portions 25L and 25R when viewed along the rotation axis C1. Accordingly, the shapes of cross sections of the shaft bearing holes 76L and 76R orthogonal to the rotation axis C1 are similar to the bottom surfaces of the shaft portions 25L and 25R respectively, and are slightly larger than the bottom surfaces of the shaft portions 25L and 25R so as to be able to receive the shaft portions 25L and 25R respectively.

The head cap 7 rotates between the closed position and the open position due to the shaft portions 25L and 25R undergoing relative rotation around the rotation axis C1 in the shaft bearing holes 76L and 76R, respectively. At this time, due to the shaft portions 25L and 25R and the shaft bearing holes 76L and 76R having the above-described shapes, the biasing mechanism D1 can generate the above-described biasing force.

Figure 8A:
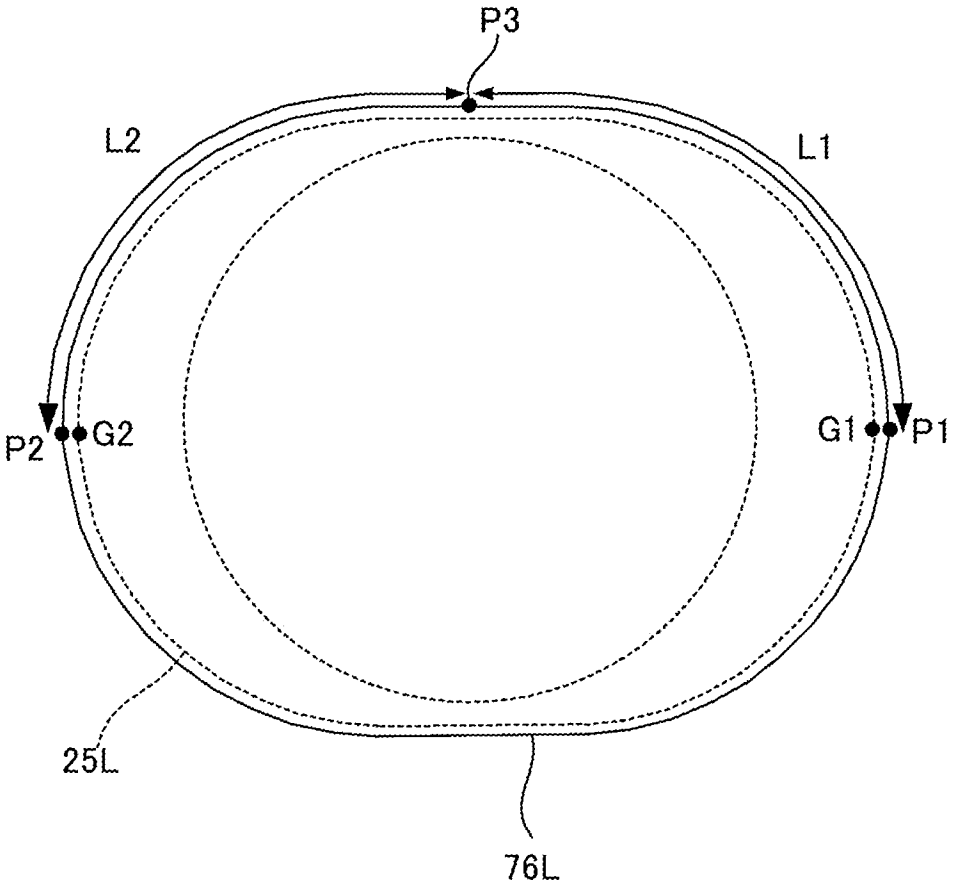
FIG. 8A is a diagram showing the positional relationship between the shaft portions and shaft bearing holes in a view along the rotation axis when the head cap is at the closed position.
Figure 8B:
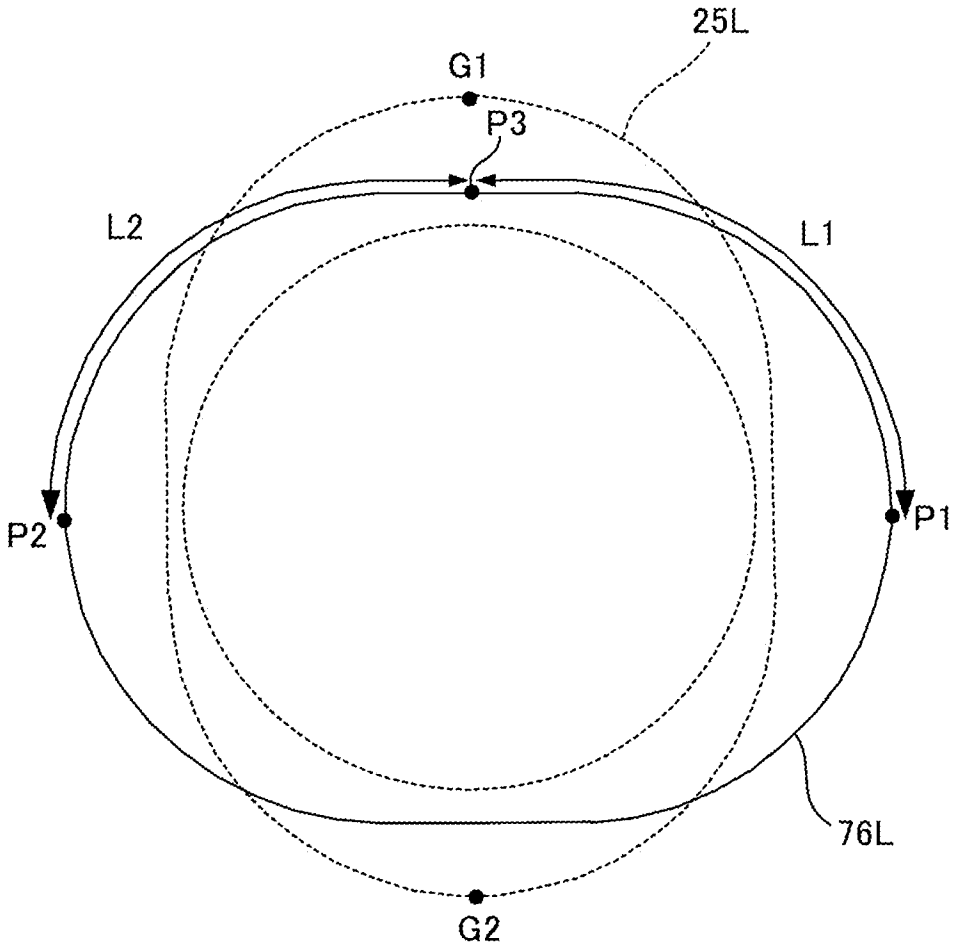
FIG. 8B is a diagram showing the positional relationship between the shaft portions and the shaft bearing holes in a view along the rotation axis when the head cap is at the dead center point.
Figure 8C:
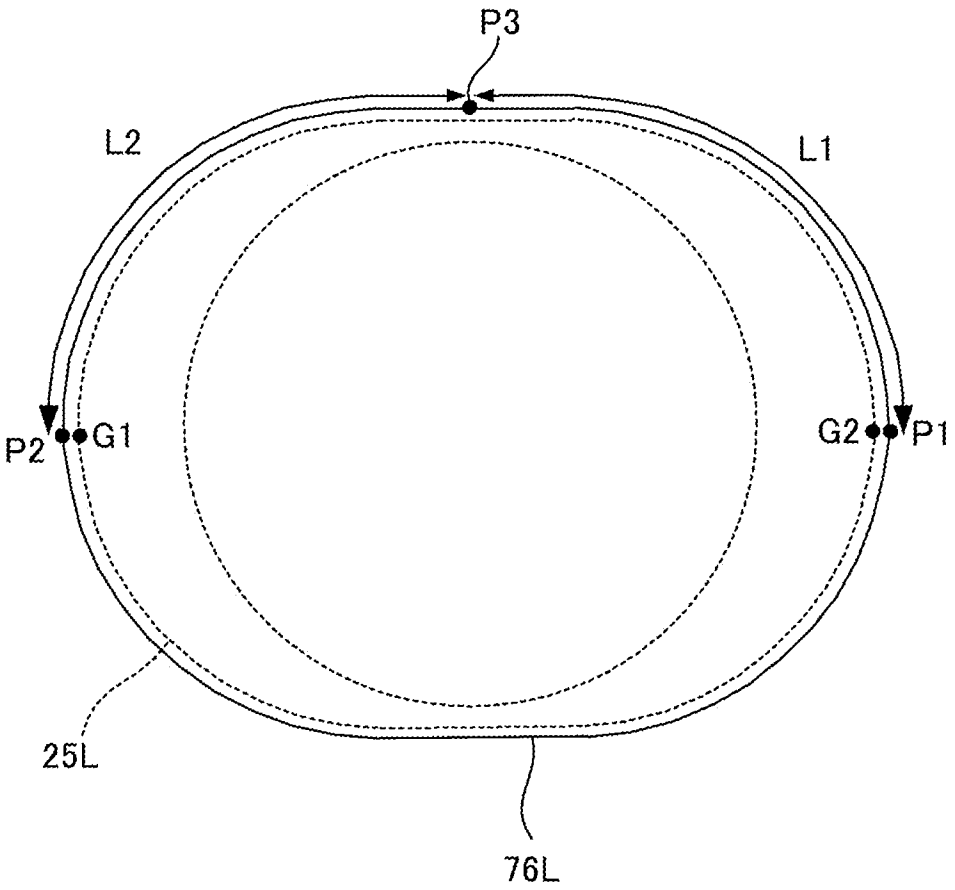
FIG. 8C is a diagram showing the positional relationship between the shaft portions and the shaft bearing holes in a view along the rotation axis when the head cap is at the open position.

FIGS. 8A to 8C are diagrams showing the positional relationship between the shaft portion 25L and the shaft bearing hole 76L when viewed along the rotation axis C1, and respectively show the head cap 7 at the closed position, the dead center point, and the open position. In these figures, the shaft bearing hole 76L is shown by a solid line and the shaft portion 25L is shown by a dotted line. Note that FIGS. 8A to 8C show the state of the left shaft portion 25L and the shaft bearing hole 76L, and mainly only the left shaft portion 25L and the shaft bearing hole 76L are described below with reference to these figures, but the description similarly applies to the shaft portion 25R and the shaft bearing hole 76R on the right side.

As shown in FIGS. 8A to 8C, in a view along the rotation axis C1, the outer periphery of the shaft bearing hole 76L has a first position P1 and a second position P2, a third position P3 located between the positions P1 and P2, a first transition region L1 that extends from the third position P3 toward the first position P1, and a second transition region L2 that extends from the third position P3 toward the second position P2. In the present embodiment, the third position P3 is located at the center (including substantially the center) between the first position P1 and the second position P2. Also, in the present embodiment, the first transition region L1 is continuous with both the third position P3 and the first position P1, and the second transition region L2 is continuous with both the third position P3 and the second position P2.

The first position P1 and the second position P2 are arranged on the outer periphery of the elliptical shape of the shaft bearing hole 76L at positions intersecting the two ends of the long axis corresponding to the maximum diameter of the elliptical shape. The third position P3 is arranged on the outer periphery of the shaft bearing hole 76L at a position intersecting one end of the short axis corresponding to the minimum diameter of the elliptical shape. Note that the diameter of the shape here means the length of a line segment that passes through the centroid of the shape and is segmented by the outer periphery of the shape. Also, in the present embodiment, the centroid of the outer periphery of the shaft bearing hole 76L is overlapped with the rotation axis C1 in a view along the rotation axis C1. Accordingly, the first position P1 and the second position P2 are the points that have the longest distance from the rotation axis C1 on the outer periphery of the shaft bearing hole 76L. On the other hand, the third position P3 has the shortest distance from the rotation axis C1 on the outer periphery of the shaft bearing hole 76L, and is at a shorter distance from the rotation axis C1 than the first position P1 and the second position P2 are. In the first transition region L1, the distance from the rotation axis C1 gradually increases while extending from the third position P3 toward the first position P1. Similarly, in the second transition region L2, the distance from the rotation axis C1 gradually increases while extending from the third position P3 toward the second position P2.

In a view along the rotation axis C1, the outer periphery of the shaft portion 25L also has two points G1 and G2 that intersect the two ends of the long axis corresponding to the maximum diameter. As shown in FIG. 8A, when the head cap 7 is at the closed position, the one point G1 is aligned with the first position P1. Also, as shown in FIG. 8B, when the head cap 7 is at the dead center point, the point G1 is aligned with the third position P3. Moreover, as shown in FIG. 8C, when the head cap 7 is at the open position, the point G1 is aligned with the second position P2.

As shown in FIGS. 8A, 4A and 4B, when the point G1 is aligned with the first position P1, the shaft portion 25L is completely housed in the shaft bearing hole 76L when viewed along the rotation axis C1. Similarly, as shown in FIGS. 8C, 6A and 6B, when the point G1 is aligned with the second position P2, the shaft portion 25L is completely housed in the shaft bearing hole 76L when viewed along the rotation axis C1. Accordingly, when the point G1 is aligned with the first position P1 or the second position P2, or in other words when the head cap 7 is at the closed position or the open position, the members in the vicinity of the shaft portion 25L and the shaft bearing portion 75L do not undergo elastic deformation. In other words, since the members in the vicinity of the shaft portion 25L and the shaft bearing portion 75L do not undergo deformation, the head cap 7 is stably located at the closed position and the open position.

On the other hand, as shown in FIGS. 8B, 5A and 5B, when the point G1 is aligned with the third position P3, the bottom surface of the shaft portion 25L protrudes from the outer periphery of the shaft bearing hole 76L when viewed along the rotation axis C1, and thus the shaft portion 25L cannot be completely housed in the shaft bearing hole 76L. Accordingly, at this time, the members in the vicinity of the shaft portion 25L and the shaft bearing portion 75L undergo elastic deformation. More specifically, in the present embodiment, mainly, the elastic piece 26L connected to the shaft portion 25L undergoes elastic deformation so as to move slightly outward, and the elastic piece 72L that includes the shaft bearing portion 75L also undergoes elastic deformation so as to move slightly inward. At this time, in the elastically deformed members, elastic force is generated for returning to a non-deformed state such the point G1 is aligned with the first position P1 and the second position P2. However, at this time, because the head cap 7 is at the dead center point, even if it attempts to tilt to the closed position or the open position, it remains at the dead center point unless subjected to an external force acting toward the closed position or the open position.

Also, when the point G1 is in the first transition region L1, the head cap 7 is located on the closed position side of the dead center point. At this time, in a view along the rotation axis C1, although to a smaller extent than when the head cap 7 is at the dead center point, the bottom surface of the shaft portion 25L protrudes from the outer periphery of the shaft bearing hole 76L, and thus the shaft portion 25L cannot be completely housed in the shaft bearing hole 76L. Accordingly, even at this time, the members in the vicinity of the shaft portion 25L and the shaft bearing portion 75L undergo elastic deformation. More specifically, in the present embodiment, mainly, the elastic piece 26L connected to the shaft portion 25L undergoes elastic deformation so as to move slightly outward, and the elastic piece 72L that includes the shaft bearing portion 75L also undergoes elastic deformation so as to move slightly inward. As a result, in this case as well, in the elastically deformed members, elastic force is generated for returning to a non-deformed state such the point G1 is aligned with the first position P1 and the second position P2. This elastic force acts as biasing force that biases the head cap 7 toward the closed position. This is because in the first transition region L1, the distance from the rotation axis C1 increases as the position moves toward the closed position, and thus the elastic force weakens and the state transitions toward a more stable state. Accordingly, the head cap 7 is moved to the closed position by this elastic force.

The same can be said when the head cap 7 is on the open position side of the dead center point. Specifically, when the point G1 is in the second transition region L2, the head cap 7 is located on the open position side of the dead center point. At this time, in a view along the rotation axis C1, although to a smaller extent than when the head cap 7 is at the dead center point, the bottom surface of the shaft portion 25L protrudes from the outer periphery of the shaft bearing hole 76L, and thus the shaft portion 25L cannot be completely housed in the shaft bearing hole 76L. Accordingly, at this time as well, the members in the vicinity of the shaft portion 25L and the shaft bearing portion 75L undergo elastic deformation. More specifically, in the present embodiment, mainly, the elastic piece 26L connected to the shaft portion 25L undergoes elastic deformation so as to move slightly outward, and the elastic piece 72L that includes the shaft bearing portion 75L also undergoes elastic deformation so as to move slightly inward. As a result, in this case as well, in the elastically deformed members, elastic force is generated for returning to a non-deformed state such the point G1 is aligned with the first position P1 and the second position P2. This elastic force acts as biasing force that biases the head cap 7 toward the open position. This is because in the second transition region L2, the distance from the rotation axis C1 increases as the position moves toward the open position, and thus the elastic force weakens and the state transitions toward a more stable state. Accordingly, the head cap 7 is moved to the open position by this elastic force.

As described above, in the present embodiment, when the relative rotation positions of the shaft portions 25L and 25R in the shaft bearing holes 76L and 76R change along with rotation of the head cap 7, a change occurs in the magnitude of the elastic force that acts on members in the vicinity of the shaft portions 25L and 25R and the shaft bearing portions 75L and 75R. Here, the biasing mechanism D1 of the head cap 7 that has a simple structure is realized by using such elastic force as biasing force. Accordingly, a highly durable head cap biasing mechanism is provided.

3. Variations

Although an embodiment of the present invention has been described above, the present invention is not limited to the above embodiment, and various modifications can be made without departing from the spirit of the present invention. For example, modifications such as the following can be made. Also, the gist of the following modifications can be combined as appropriate.

3-1

In the above embodiment, the shaft portions 25L and 25R are provided in the cassette 2 and the shaft bearing portions 75L and 75R are provided in the head cap 7, but a configuration is possible in which the shaft portions 25L and 25R are provided in the head cap 7, and the shaft bearing portions 75L and 75R are provided in the cassette 2. Also, if the shaft bearing portions 75L and 75R are provided in the head cap 7, the shaft portions 25L and 25R can be provided in the transfer head 5 instead of the cassette 2. Similarly, if the shaft portions 25L and 25R are provided in the head cap 7, the shaft bearing portions 75L and 75R can be provided in the transfer head 5 instead of the cassette 2.

3-2

In the above embodiment, when the head cap 7 is at the third position P3 or in the first transition region L1 or the second transition region L2, mainly the elastic pieces 26L and 26R provided in the cassette 2 and the elastic pieces 72L and 72R provided in the head cap 7 undergo elastic deformation. However, the members that undergo elastic deformation are not limited to these members, and a configuration is possible in which not only the shaft portions 25L and 25R and the shaft bearing portions 75L and 75R, but also members in the vicinity of the shaft portions 25L and 25R and the shaft bearing portions 75L and 75R undergo elastic deformation as appropriate. Also, in general, a configuration is possible in which mainly only members included in the cassette 2 undergo elastic deformation, or only members included in the head cap 7 undergo elastic deformation. Furthermore, if the shaft portions 25L and 25R or the shaft bearing portions 75L and 75R are provided in the transfer head 5 as in Variation 3-1, a configuration is possible in which mainly members included in the transfer head 5 undergo elastic deformation.

3-3

In the above embodiment, there is only one dead center point between the closed position and the open position, but there may be two or more dead center points. At this time, the user can rotate the head cap 7 from the closed position to the open position by applying force the same number of times as the number of dead center points. More specifically, first, when the head cap 7 is manually pushed from the closed position to a point slightly past the dead center point closest to the closed position, the head cap 7 automatically rotates by a certain angle from the dead center point toward the open position, and becomes stability positioned there. Then, when the head cap 7 is manually pushed to a point slightly past the next dead center point, the head cap 7 automatically rotates by a certain angle again from the dead center point toward the open position, and becomes stability positioned there. Such a task may be repeated until the head cap 7 reaches the open position. This similarly applies to the case where the head cap 7 is rotated from the open position to the closed position.

3-4

Figure 9:
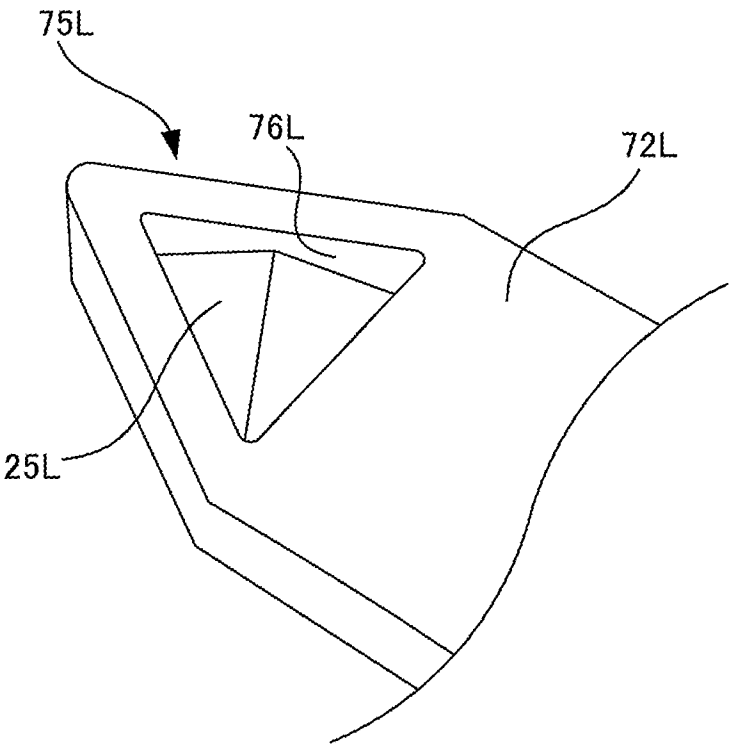
FIG. 9 is a perspective view of the shaft portions and the shaft bearing portions according to a variation.

The shapes of the shaft portions 25L and 25R and the shaft bearing holes 76L and 76R are not limited to the shapes described above. For example, the shaft portions 25L and 25R and the shaft bearing holes 76L and 76R can be polygonal when viewed along the rotation axis C1, and in this case, the shape is preferably a regular polygon. FIG. 9 shows an example of the case where the shaft portions 25L and 25R and the shaft bearing holes 76L and 76R are shaped as equilateral triangles when viewed along the rotation axis C1. However, only the left shaft portion 25L and the shaft bearing hole 76L are shown in FIG. 9.

Also, the shaft portions 25L and 25R do not need to have a frustum shape (a shape having a bottom surface and a top surface, and having a cross section that gradually decreases in size from the bottom surface toward the top surface), and may be cone-shaped as in the example of FIG. 9, or may be shaped as column whose cross-sectional shape does not change in the height direction. In the latter case, it is preferable that the heights of the shaft portions 25L and 25R are set low, and that the shaft portions 25L and 25R and the shaft bearing portions 75L and 75R are made of a material that more easily undergoes elastic deformation such as an elastomer.

Figure 10:
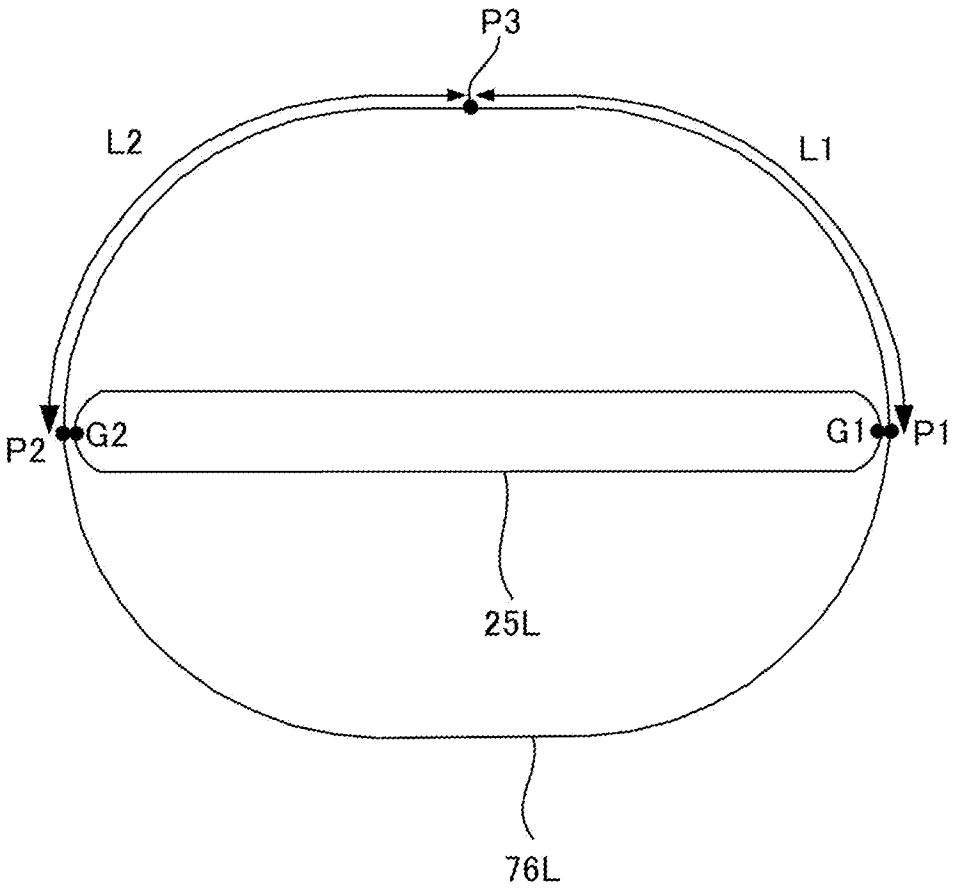
FIG. 10 is a view of the shaft portions and the shaft bearing portions according to another variation in a view along the rotation axis.

Also, the shapes of the shaft portions 25L and 25R and the shaft bearing holes 76L and 76R do not need to be similar to each other when viewed along the rotation axis C1. For example, even if the shaft portions 25L and 25R and the shaft bearing holes 76L and 76R are shaped as shown in FIG. 10, a dead center point can be formed.

LIST OF REFERENCE NUMERALS

1 Coating film transfer tool
2 Cassette
25L, 25R Shaft portion
3 Feeding reel (feeding portion)
4 Winding reel (winding portion)
5 Transfer head
6 Head cap
75L, 75R Shaft bearing portion
76L, 76R Shaft bearing hole
C1 Rotation axis
T0 Base tape
T1 Transfer tape
P1 First position
P2 Second position P3 Third position
L1 First transition region
L2 Second transition region

The invention claimed is:

1. A coating film transfer tool comprising:

a feeding portion configured to feed a transfer tape that includes a base tape and a coating film provided on the base tape;

a transfer head configured to transfer the coating film fed from the feeding portion to a transfer target surface by pressing the transfer tape onto the transfer target surface;

a winding portion configured to wind the base tape after transfer of the coating film;

a cassette that houses the feeding portion and the winding portion, and to which the transfer head is fixed; and a head cap configured to rotate between a closed position for covering the transfer head and an open position for exposing the transfer head, wherein out of two elements including the head cap and the transfer head or the cassette, a shaft portion having a rotation axis is provided on one of the two elements, a shaft bearing portion having a shaft bearing hole that receives the shaft portion is provided on another one of the two elements, and the head cap rotates between the closed position and the open position by relative rotation of the shaft portion around the rotation axis in the shaft bearing hole, the shaft portion has a conical shape or a frustrum shape, in a view along the rotation axis, a distance from the rotation axis to the shaft portion changes along a circumferential direction, in a view along the rotation axis, a distance from the rotation axis to the shaft bearing hole changes along the circumferential direction, and when the head cap is on a closed position side of a dead center point that is between the closed position and the open position, the head cap is biased toward the closed position by an elastic force that acts on at least one of the two elements, and when the head cap is on an open position side of the dead center point, the head cap is biased toward the open position by an elastic force that acts on at least one of the two elements.

2. The coating film transfer tool according to claim 1, wherein the shaft bearing hole and the shaft portion each have an elliptical shape in a view along the rotation axis.

3. The coating film transfer tool according to claim 1, wherein in a view along the rotation axis, the shaft portion has, on an outer periphery, a first point and a second point that intersect a line segment corresponding to a maximum diameter of the shaft portion, in a view along the rotation axis, the shaft bearing hole has, on an outer periphery:

a first position, a second position, a third position that is located between the first position and the second position, and is at a shorter distance from the rotation axis than the first position and the second position are, a first transition region that is continuous with the third position and extends from the third position toward the first position, a distance from the rotation axis to the outer periphery of the shaft bearing hole gradually increasing while extending from the third position to the first position, and a second transition region that is continuous with the third position and extends from the third position toward the second position, the distance from the rotation axis to the outer periphery of the shaft bearing hole gradually increasing while extending from the third position to the second position, the head cap is at the closed position when the first point is aligned with the first position, the head cap is at the open position when the first point is aligned with the second position, the head cap is at the dead center point when the first point is aligned with the third position, when the first point is in the first transition region, the head cap is on a closed position side of the dead center point and is biased toward the closed position, and when the first point is in the second transition region, the head cap is on an open position side of the dead center point and is biased toward the open position.

4. The coating film transfer tool according to claim 2, wherein in a view along the rotation axis, the shaft portion has, on an outer periphery, a first point and a second point that intersect a line segment corresponding to a maximum diameter of the shaft portion, in a view along the rotation axis, the shaft bearing hole has, on an outer periphery:

a first position, a second position, a third position that is located between the first position and the second position, and is at a shorter distance from the rotation axis than the first position and the second position are, a first transition region that is continuous with the third position and extends from the third position toward the first position, a distance from the rotation axis to the outer periphery of the shaft bearing hole gradually increasing while extending from the third position to the first position, and a second transition region that is continuous with the third position and extends from the third position toward the second position, the distance from the rotation axis to the outer periphery of the shaft bearing hole gradually increasing while extending from the third position to the second position, the head cap is at the closed position when the first point is aligned with the first position, the head cap is at the open position when the first point is aligned with the second position, the head cap is at the dead center point when the first point is aligned with the third position, when the first point is in the first transition region, the head cap is on a closed position side of the dead center point and is biased toward the closed position, and when the first point is in the second transition region, the head cap is on an open position side of the dead center point and is biased toward the open position.

* * * * *